US008430344B2

(12) United States Patent
Cai et al.

(10) Patent No.: US 8,430,344 B2
(45) Date of Patent: Apr. 30, 2013

(54) SWAYABLE AND RETRACTABLE SHOWER

(75) Inventors: Tao Cai, Xiamen (CN); Shenghe Chen, Xiamen (CN); Hua Yao, Xiamen (CN); Huasong Zhou, Xiamen (CN)

(73) Assignees: Xiamen Solex High-Tech Industries Co., Ltd., Xiamen (CN); Huasong Zhou, Xiamen (CN)

( * ) Notice: Subject to any disclaimer, the term of this patent is extended or adjusted under 35 U.S.C. 154(b) by 119 days.

(21) Appl. No.: 13/122,587

(22) PCT Filed: Feb. 10, 2010

(86) PCT No.: PCT/CN2010/070608

§ 371 (c)(1),
(2), (4) Date: Apr. 5, 2011

(87) PCT Pub. No.: WO2011/032369

PCT Pub. Date: Mar. 24, 2011

(65) Prior Publication Data

US 2011/0186653 A1 Aug. 4, 2011

(30) Foreign Application Priority Data

Sep. 16, 2009 (CN) ..... 2009 2 0310552 U

(51) Int. Cl.
*B05B 1/18* (2006.01)
*B05B 15/08* (2006.01)
*B05B 1/32* (2006.01)

(52) U.S. Cl.
USPC ..... 239/587.4; 239/447; 239/448; 239/449; 239/538; 239/540; 239/587.3

(58) Field of Classification Search ..... 239/436, 239/443, 444, 446–449, 537–540, 548, 558, 239/559, 567, 587.1, 587.3, 587.4
See application file for complete search history.

(56) References Cited

U.S. PATENT DOCUMENTS

| | | | | |
|---|---|---|---|---|
| 2001/0008256 | A1 * | 7/2001 | Marsh et al. | 239/381 |
| 2004/0056123 | A1 * | 3/2004 | Douglas et al. | 239/587.4 |
| 2005/0156062 | A1 * | 7/2005 | Thomas et al. | 239/548 |
| 2007/0205310 | A1 * | 9/2007 | Zhou | 239/587.1 |
| 2007/0245487 | A1 * | 10/2007 | Zhou | 4/675 |

FOREIGN PATENT DOCUMENTS

| | | | |
|---|---|---|---|
| CN | 2180190 | Y | 10/1994 |
| CN | 2191884 | Y | 3/1995 |
| CN | 2319130 | Y | 5/1999 |
| CN | 2319131 | Y | 5/1999 |
| CN | 2397871 | Y | 9/2000 |
| CN | 2887450 | Y | 4/2007 |
| GB | 2297930 | A | 8/1996 |
| JP | 2006101914 | A | 4/2006 |

* cited by examiner

*Primary Examiner* — Darren W Gorman
(74) *Attorney, Agent, or Firm* — Rabin & Berdo, P.C.

(57) ABSTRACT

A swayable and retractable shower, includes a retractable assembly and a shower head. The retractable assembly includes a fixed portion, a retractable portion and a reset portion. The fixed portion has a through sliding hole. The retractable portion with a through water entry is hermetically and slidably connected in the through sliding hole. The reset portion is disposed between the fixed portion and the retractable portion. The water entry communicates with the through sliding hole. The shower head is swayably connected to the lower end of the retractable portion and can communicate with the water entry, so the shower head can swing left or right in optional directions when it is stretched out.

11 Claims, 5 Drawing Sheets

SWAYABLE AND RETRACTABLE SHOWER

FIELD OF THE INVENTION

The present invention relates to a shower, especially relates to a swayable and retractable shower.

BACKGROUND OF THE INVENTION

The Chinese patent database disclosed a utility patent titled Automatically retractable kitchen shower on Apr. 11, 2007 with application NO. ZL200620054258.0. Said automatically retractable kitchen shower mainly comprises a main body, a shower head and a reset spring; a joint head is disposed above the main body and is fixed to the outer end of a flexible pipe, the middle of the main body has a guiding pipe; a sliding pipe is above the shower head and sleeved in the guiding pipe of the main body, and a water channel for the flexible pipe, joint head, sliding pipe and shower head is formed, a retaining platform is formed on the inner wall of the guiding pipe and a protruding platform is correspondingly formed on the outer wall of the sliding pipe, the reset spring sleeves the outside of the sliding pipe and its two ends leaned against the retaining platform and the protruding platform, the sliding pipe will drive the shower head reset upward due to the reset spring, sealing rings are also disposed between each members. However, because said shower head is fixed, so there are some shortages: 1. the direction of the shower head can not be adjusted according to the practical condition and requirements; 2. the water outflow function of the shower head is single.

SUMMARY OF THE INVENTION

The present invention provides a swayable and retractable shower, which overcomes the shortages of the conventional technique of the difficulty of the direction adjustment of the shower head and its single water outflow function.

The technical solution applied by the present invention is:

A swayable and retractable shower, wherein it comprises:

a retractable assembly, it comprises a fixed portion, a retractable portion and a reset portion, said fixed portion has a through sliding hole, said retractable portion with a through water entry is hermetically and slidably connected in the through sliding hole, said reset portion is disposed between the fixed portion and the retractable portion, said water entry communicates with the through sliding hole; and a shower head communicates with the water entry, which is swayably connected to the lower end of the retractable portion.

In a preferred embodiment, said shower head is a rotational switch shower head.

In a preferred embodiment, said fixed portion comprises a joint head and a housing hermetically fixed to the joint head, the outer periphery of the top end of said joint head is an outer thread, the inside of said housing forms said through sliding hole, the lower periphery of said through sliding hole protrudes inward to form a bead.

In a preferred embodiment, said retractable portion comprises a connecting rod and a sliding head hermetically and slidably connected to the inside of the through sliding hole, said connecting rod stretches into the through sliding hole down to up and is fixed under the sliding head, the lower end of said connecting rod is a ball head, said sliding head has a first through hole, said connecting rod has a second through hole, the axis of said first through hole aligns with the axis of said second through hole, and the water entry is formed by the first and second through holes.

In a preferred embodiment, said reset portion sleeves the connecting rod and is leaned against between the sliding head and the bead.

In a preferred embodiment, said shower head is swayably connected to the ball head.

In a preferred embodiment, said shower head comprises a main body, a water outflow assembly with two water outflow functions and a switch mechanism which can control one of the water outflow functions communicate with the water entry.

In a preferred embodiment, the left and right of said ball head are respectively disposed with an assembling groove, a bushing with a shaft comprises a circular sleeve and two inserting members fixed in said circular sleeve, said two inserting members are respectively connected in the two assembling grooves, further, the horizontal distance between said assembling grooves is adapted to the horizontal distance between said inserting members, the vertical distance between said assembling grooves is greater than the vertical distance between said inserting members, said main body sleeves the outside of said bushing and supported by said bushing.

In a preferred embodiment, said main body rotatably sleeves the retractable portion; said water outflow assembly is fixed in the main body, which comprises a water division member and two water outflow functions, said water division member has two water division holes respectively communicating with the two water outflow functions;

said switch mechanism has a switch member hermetically connected to the ball head, said switch member has a water inlet communicating with the water entry, the inside of the lower end of said water inlet has a sealing gasket assembly with an elastic member; said sealing gasket assembly selectively seals one of the two water division holes along with the relative rotation between the switch member and the water division member.

In a preferred embodiment, said one water outflow function flows shower water, another one flows massage water.

Compared to the background technique: the present applicant ingeniously combine the retraction and sway character together, so the shower head can swing left or right in optional directions when it is stretched out, so the user can adjust the direction of the shower head according to practical condition and requirements, the shower head will not swing due to the restriction of the fixed portion when the shower head is retracted, so as to protect the shower head. Because said shower head is a rotational switch shower head, so the water outflow functions can be adjusted according to different needs. Because the outer periphery of the top end of said joint head is an outer thread, so it is convenient for fixing the joint head into the water pipe. Because the shower head is swayably connected to the ball head, so it is convenient for realizing the sway function. Because the horizontal distance between said assembling grooves is adapted to that of said inserting members, and the vertical distance between said assembling grooves is greater that of said inserting members, so the bushing with a shaft can not rotate transversely relative to the ball head but can swing left or right in optional directions. Because said main body sleeves the outside of the bushing and supported by said bushing, so the shower head is swayably connected to the ball head and the retractable portion, and the shower head is rotatably connected to the outside of the retractable portion. Because the switch member is hermetically connected to the ball head, so it can avoid the water leakage during the sway process.

BRIEF DESCRIPTION OF THE DRAWINGS

The present invention will become apparent with the reference of the accompanying drawings and the embodiments.

DETAILED DESCRIPTION OF THE EMBODIMENTS

Figure 1:
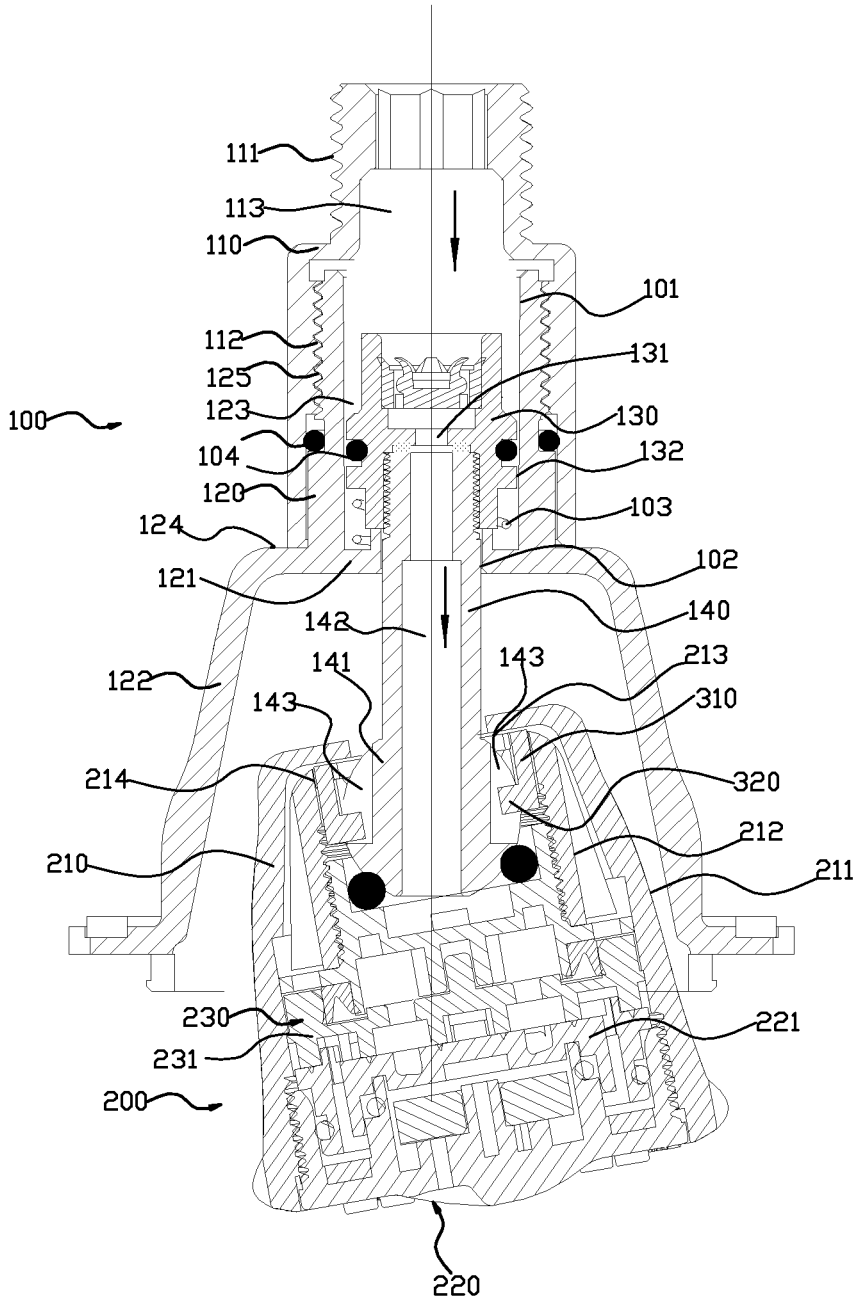
FIG. 1 is the sectional view of the swayable and retractable shower of a preferred embodiment when the shower is stretched out and swayed.
Figure 2:
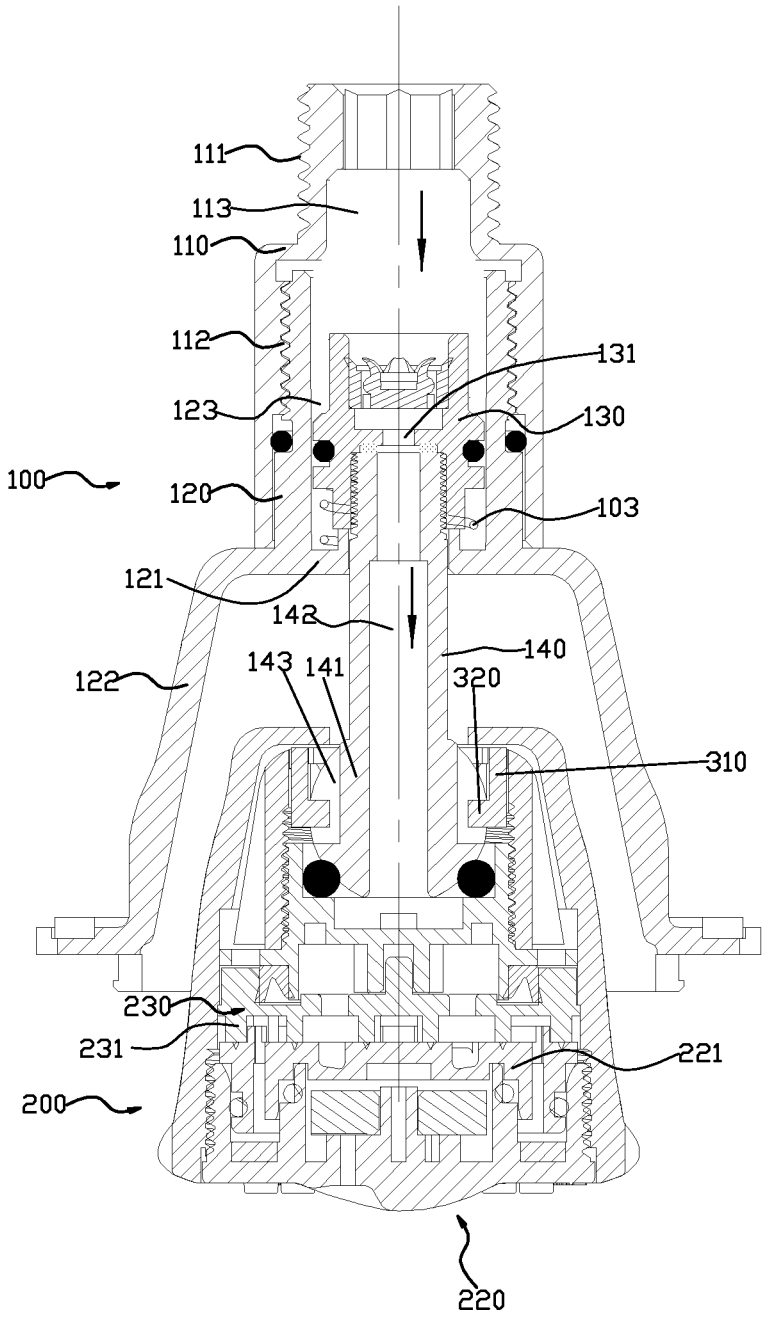
FIG. 2 is the sectional view of the swayable and retractable shower of a preferred embodiment when the shower is stretched out.
Figure 3:
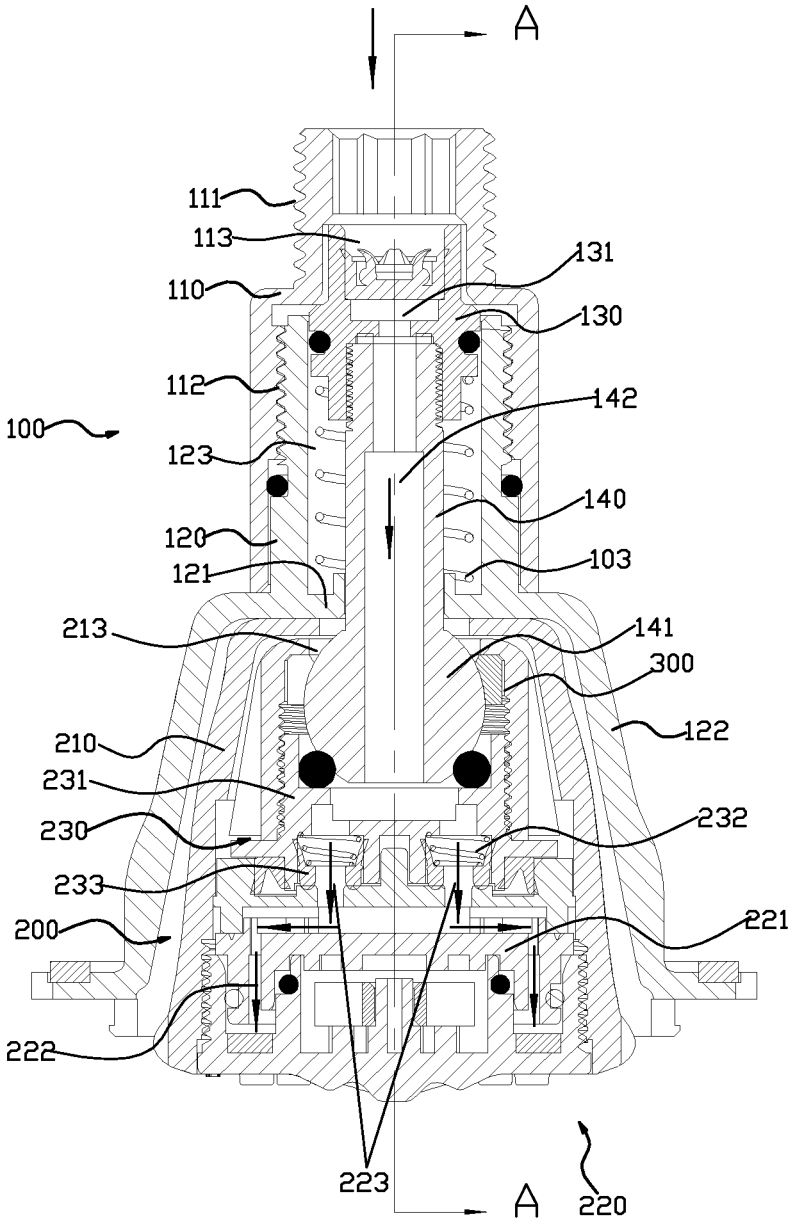
FIG. 3 is the sectional view of the swayable and retractable shower of a preferred embodiment when the shower is retracted and the first water outflow function works.
Figure 4:
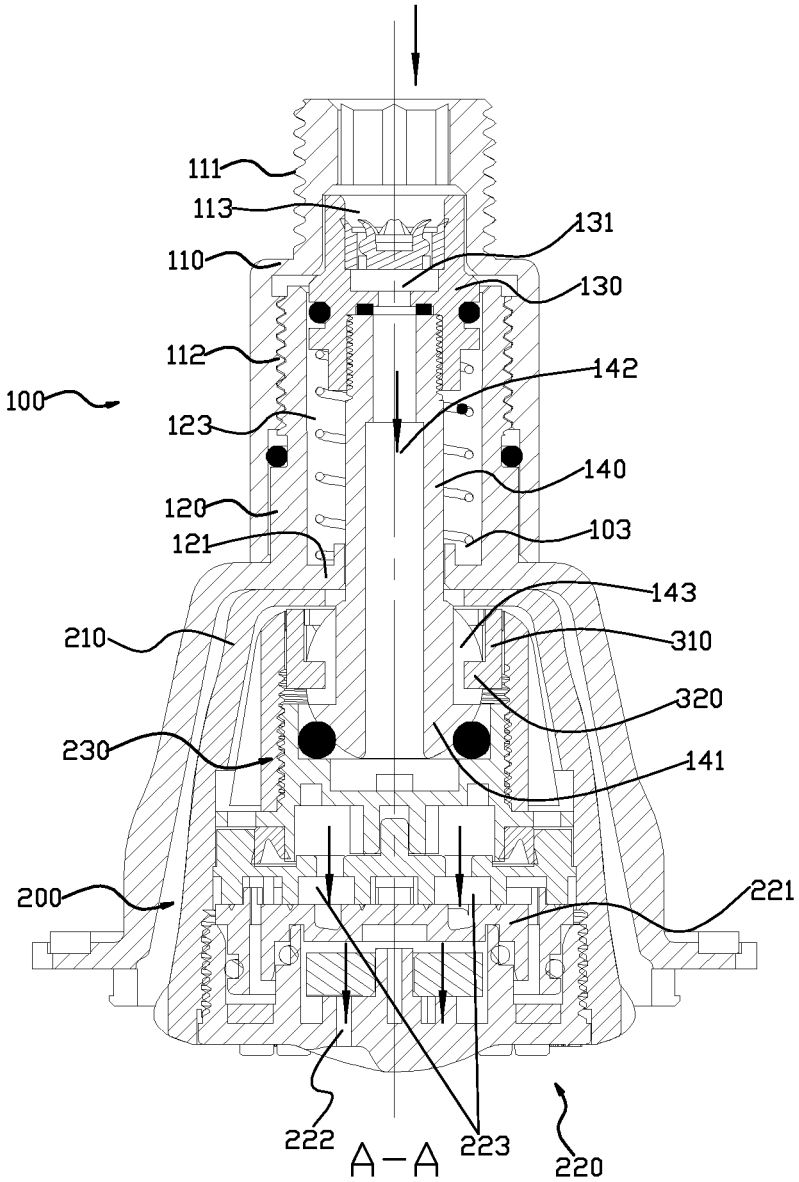
FIG. 4 is the sectional view of the swayable and retractable shower of a preferred embodiment when the shower is retracted and the second water outflow function works, further the FIG. 4 is the sectional view of the A-A line direction of FIG. 3.
Figure 5:
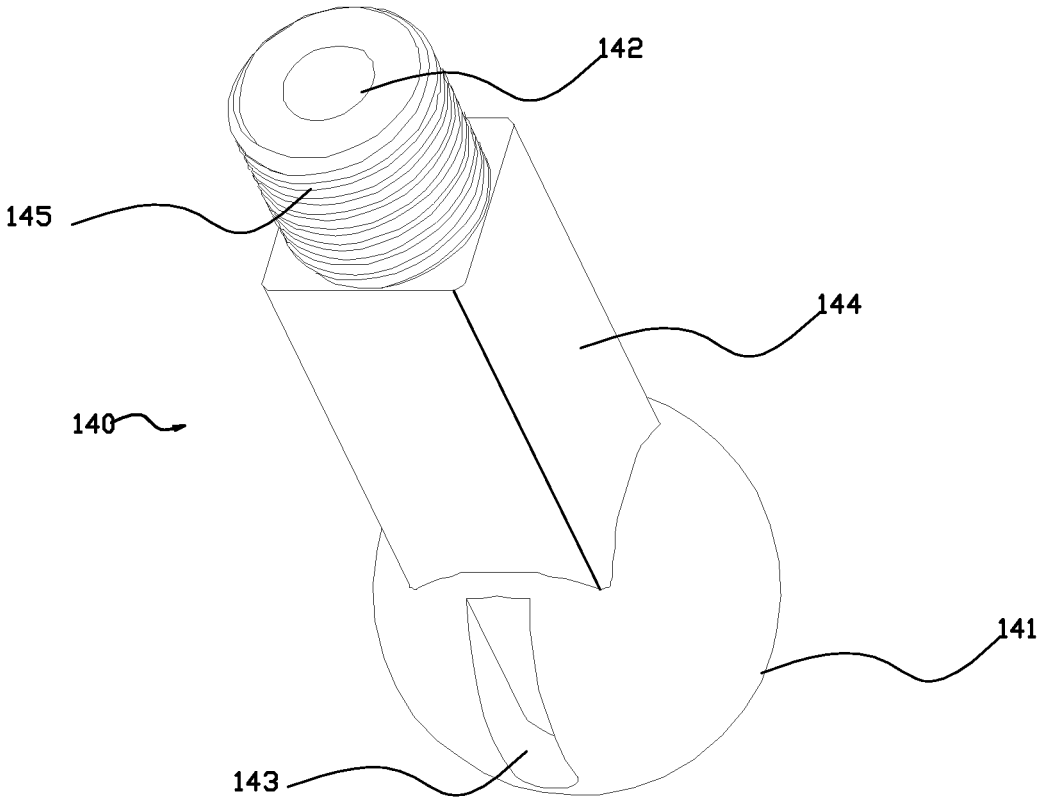
FIG. 5 is the perspective view of the connecting rod of the swayable and retractable shower of a preferred embodiment.
Figure 6:
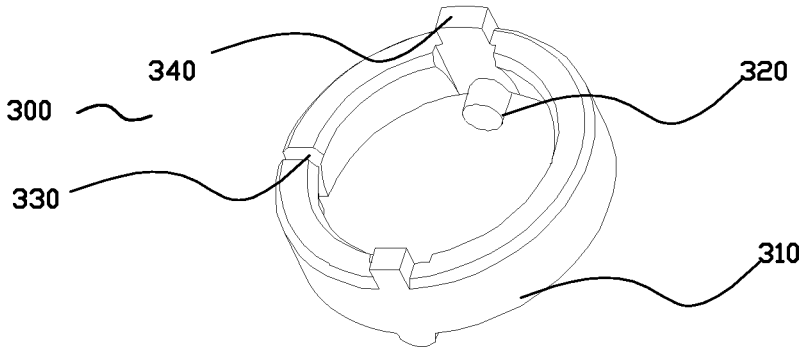
FIG. 6 is the perspective view of the bushing with a shaft of the swayable and retractable shower of a preferred embodiment.

Please refer FIG. 1 to FIG. 6, a swayable and retractable shower, comprising a retractable assembly 100 and a shower head 200.

Said retractable assembly 100 comprises a fixed portion 101, a retractable portion 102 and a reset spring 103.

Said fixed portion 101 comprises a revolving joint head 110 and a revolving housing 120 hermetically fixed to the joint head 110.

Said joint head 110 is a hollow stepped structure which gets broader from up to down, it further has a upper section and a lower section; the outer periphery of said upper section has an outer thread 111 for fixing said retractable shower to the water pipe; the inner periphery of said lower section has an inner thread 112; the hollow hole of said joint head 110 is a first hollow hole 113.

Said housing 120 has a revolving section, a bead 121 formed by extending inward from the inner and lower periphery of the revolving section, a circular plate 124 formed by extending outward from the outer and lower periphery of the revolving section and a horn member 122 fixed under the circular plate 124; a quadrate sliding way 125 is formed by extending upward from the center of the bead 121, an outer thread 111 is disposed on the outer periphery of the revolving section.

The housing 120 is thread joint with the inner thread 112 of the joint head 110, a sealing ring 104 is disposed between the housing 120 and the joint head 110 as needed; said revolving section of the housing 120 is hollow and forms a second hollow hole 123, the axis of said first hollow hole 113 aligns with the axis of said second hollow hole 123 and a through sliding hole is formed by the first and second hollow holes.

Said retractable portion 102 comprises a connecting rod 140 and a sliding head 130 hermetically and slidably connected to the inside of the second hollow hole 123 of the through sliding hole.

The lower end of said connecting rod 140 forms a ball head 141, the middle part of which is a quadrate sliding rod 144, the top part of which is a thread joint portion 145, further is has a second through hole 142, the left and right of said ball head 141 are respectively disposed with an assembling groove 143.

Said sliding head 130 has a first through hole 131 which is a stepped hole, the upper end of the first through hole 131 is a big hole, the middle part of the first through hole 131 shrinks to form a small hole, the lower part of the first through hole 131 is a thread hole; the outside of said sliding head 130 has a retaining ring 132 with a sealing ring 104 embedded inside.

Said reset spring 103 is a compression spring.

Said connecting rod 140 stretches into the second hollow hole 123 of the through sliding hole from down to up, and fixed under the sliding head 130 through the thread joint portion 145, the quadrate rod 144 of the middle of the connecting rod 140 is in the quadrate sliding way 125 of the housing 120, the water entry of the connecting rod 140 communicates with the through hole 131 of the sliding head 130; the reset spring 103 sleeves and connected to the connecting rod 140, further it is leaned against between the retaining ring 132 of the sliding head 130 and the bead 121 of the housing 120.

Said shower head 200 is a rotational switch shower head, in the present embodiment, it comprises a main body 210, a water outflow assembly 210 with two water outflow functions and a switch mechanism 230 controlling one of the water outflow functions selectively communicate with the water entry.

A bushing 300 with a shaft, comprising a circular sleeve 310 and two inserting members 320 fixed in the circular sleeve 310, said circular sleeve 310 has an elastic opening 330, two positioning protruding members 340 are respectively disposed on the circular sleeve 310 and extend upward from the inserting members 320.

The bushing 300 with a shaft sleeves on the ball head 141, the two inserting members 320 respectively connected in the two assembling grooves 143 of the ball head 141, wherein, the horizontal distance between said assembling grooves 143 is adapted to the horizontal distance between said inserting members 320, the vertical distance between said assembling grooves 143 is greater than the vertical distance between said inserting members 320, so said bushing 300 with a shaft is swayably connected to the ball head 141.

Said main body 210 comprises an outer sleeve 211 and a sleeve joint member 212, said outer sleeve 211 is horn shaped and the upper end of which has a through hole, the inner diameter of the through hole is smaller than the diameter of the ball head 141; the sleeve joint member 212 is cylindrical, the top surface of the cylinder has a pair of through holes 213 of the retaining groove 214 (please refer FIG. 1, FIG. 3); the sleeve joint member 212 sleeves the outside of the ball head 141 of the bushing 300, the two positioning protruding members 340 of the bushing 300 are restricted by the retaining groove 214, then the outer sleeve 211 sleeves outside, so said shower head 200 can be swayably connected to the ball head 141, said shower head 200 can rotatably sleeves the retractable portion.

Said water outflow assembly 220 is fixed in the outer sleeve 211 of the main body 210, which comprises a water division member 221 and two water outflow function members 222, said water division member has two water division holes 223 which respectively communicate with the two water outflow function members 222.

Said switch mechanism 230 has a switch member 231 which can hermetically connected to the ball head 141, said switch member 231 is further connected to the inside of the sleeve joint member 212 of the main body 210; the switch member 231 has a water inlet 232 which can communicate with the water entry, the inside of the lower end opening of said water inlet 232 has a sealing gasket assembly 233 with an elastic member.

Opening the switch of the water pipe, under the influence of the water pressure, the compression spring 103 is compressed and drive the retractable portion 102 stretch outside, further the shower head 200 is driven to stretch outside of the housing 120. Rotating the main body 210, the water outflow assembly 220 is driven to rotate relative to the switch member 231, further the sealing gasket assembly 233 is caused to seal one of the two water division holes, so the corresponding water outflow function is chosen.

In the present embodiment, said one water outflow function flows shower water, another water outflow function flows massage water. In the present embodiment, said rotational switch shower head can also apply the existing rotational switch structure.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

INDUSTRIAL APPLICABILITY

The swayable and retractable shower of the present invention, its shower head can swing left or right in optional directions when it is stretched out, the user can adjust the direction of the shower head according to the practical condition, it is convenient for operation and has a good industrial applicability.

What is claimed is:

1. A swayable and retractable shower, comprising:

a retractable assembly, having:

a fixed portion having a through sliding hole;

a retractable portion having a connecting rod, and a sliding head hermetically and slidably disposed inside of the through sliding hole, said connecting rod stretching into the through sliding hole down to up and being fixed ender the sliding head, a lower end of said connecting rod being a ball head, said sliding head having a first through hole, said connecting rod having a second through hole, an axis of the first through hole being aligned with an axis of the second through hole, and a through water entry being formed by the first and second through holes, the through water entry communicating with the through sliding hole; and a reset portion disposed between the fixed portion and the retractable portion; and a shower head that communicates with the through water entry, and which is swayably connected to a lower end of the retractable portion, said shower head comprising a main body, a water outflow assembly with two water outflow functions, a switch mechanism which controls the water outflow functions to communicate with the through water entry and a bushing that comprises a circular sleeve, and two inserting members fixed in the circular sleeve;

wherein a left side and a right side of said ball head are respectively provided with an assembling groove, the two inserting members being respectively connected in the two assembling grooves, a horizontal distance between the assembling grooves being adapted to a horizontal distance between the inserting members, a vertical distance between the assembling grooves being greater than a vertical distance between the inserting members, said main body being sleeved over an outside of said bushing and being supported by said bushing.

2. The swayable and retractable shower according to claim 1, wherein said shower head is a rotational switch shower head.

3. The swayable and retractable shower according to claim 1, wherein said fixed portion comprises a joint head and a housing hermetically fixed to the joint head, an outer periphery of a top end of said joint head having an outer thread, an inside of said housing defining the through sliding hole, a lower periphery of the through sliding hole protruding inward to form a bead.

4. The swayable and retractable shower according to claim 1, wherein said reset portion sleeves the connecting rod and presses against the sliding head and the bead.

5. The swayable and retractable shower according to claim 1, wherein said shower head is swayably connected to the ball head.

6. A swayable and retractable shower, comprising:

a retractable assembly, having:

a fixed portion having a joint head and a housing hermetically fixed to the joint head, an outer periphery of a top end of said joint head having an outer thread, an inside of said housing defining a through sliding hole, a lower periphery of the through sliding hole protruding inward to form a bead;

a retractable portion having a connecting rod, and a sliding head hermetically and slidably disposed inside of the through sliding hole, said connecting rod stretching into the through sliding hole down to up and being fixed under the sliding head, a lower end of said connecting rod being a ball head, said sliding head having a first through hole, said connecting rod having a second through hole, an axis of the first through hole being aligned with an axis of the second through hole, and a through water entry being formed by the first and second through holes, the through water entry communicating with the through sliding hole; and a reset portion disposed between the fixed portion and the retractable portion; and a shower head that communicates with the through water entry, and which is swayably connected to the ball head, said shower head comprising a main body, a water outflow assembly with two water outflow functions, and a switch mechanism which controls the water outflow functions to communicate with the through water entry; wherein said main body rotatably sleeves the retractable portion;

said water outflow assembly is fixed in the main body, and further comprises a water division member having two water division holes respectively communicating with the two water outflow functions;

said switch mechanism has a switch member hermetically connected to the ball head, said switch member having a water inlet communicating with the through water entry, an inside of a lower end of said water inlet has a sealing gasket assembly with an elastic member; said sealing gasket assembly selectively sealing one of the two water division holes when the switch member is rotated relative to the water division member.

7. The swayable and retractable shower according to claim 6, wherein said one water outflow function flows shower water, and another one flows massage water.

8. A swayable and retractable shower, comprising:

a retractable assembly, having:

a fixed portion having a joint head and a housing hermetically fixed to the joint head, an outer periphery of a top end of said joint head having an outer thread, an inside of said housing defining a through sliding hole, a lower periphery of the through sliding hole protruding inward to form a bead;

a retractable portion having a connecting rod, and a sliding head hermetically and slidably disposed inside of the through sliding hole, said connecting rod stretching into the through sliding hole down to up and being fixed under the sliding head, a lower end of said connecting rod being a ball head, said sliding head having a first through hole, said connecting rod having a second through hole, an axis of the first through hole being aligned with an axis of the second through hole, and a through water entry being formed by the first and second through holes, the through water entry communicating with the through sliding hole; and a reset portion disposed between the fixed portion and the retractable portion; and a shower head that communicates with the through water entry, and which is swayably connected to a lower end of the retractable portion;

wherein the lower end of said connecting rod forms the ball head, a middle part is a quadrate sliding rod, and a top part is a thread joint portion.

9. A swayable and retractable shower, comprising:

a retractable assembly, having:

a fixed portion having a joint head and a housing hermetically fixed to the joint head, an outer periphery of a top end of said joint head having an outer thread, an inside of said housing defining a through sliding hole, a lower periphery of the through sliding hole protruding inward to form a bead;

a retractable portion having a connecting rod, and a sliding head hermetically and slidably disposed inside of the through sliding hole, said connecting rod stretching into the through sliding hole down to up and being fixed under the sliding head, a lower end of said connecting rod being a ball head, said sliding head having a first through hole, said connecting rod having a second through hole, an axis of the first through hole being aligned with an axis of the second through hole, and a through water entry being formed by the first and second through holes, the through water entry communicating with the through sliding hole; and a reset portion disposed between the fixed portion and the retractable portion; and a shower head that communicates with the through water entry, and which is swayably connected to a lower end of the retractable portion;

wherein the first through hole is a stepped hole that includes an upper part which is a big hole, a middle part that shrinks to form a small hole, and a lower part that is a thread hole; an outside of said sliding head having a retaining ring which has a sealing ring embedded therein.

10. The swayable and retractable shower according to claim 1, wherein an elastic opening is disposed on the circular sleeve, and two positioning protruding members are respectively disposed on the circular sleeve extend upward from the inserting members.

11. The swayable and retractable shower according to claim 10, wherein said main body comprises an outer sleeve and a sleeve joint member, the outer sleeve being horn shaped and an upper end of which has a through hole, an inner diameter of the through hole being smaller than a diameter of the ball head; the sleeve joint member is cylindrical, a top surface of which has a pair of through holes of a retaining groove; the sleeve joint member sleeves the outside of the ball head of the bushing with a shaft, the two positioning protruding members of said bushing are restricted by the retaining groove, the shower head being swayably connected to the ball head and rotatably sleeves the retractable portion.

* * * * *